United States Patent [19]

Wakabayashi

[11] Patent Number: 4,744,686

[45] Date of Patent: May 17, 1988

[54] DEVICE FOR CARRYING PRINTING HEAD

[76] Inventor: Hirotada Wakabayashi, 1-1, Taihei 4-chome, Sumida-ku, Tokyo, Japan

[21] Appl. No.: 934,156

[22] Filed: Nov. 24, 1986

[30] Foreign Application Priority Data

Nov. 26, 1985 [JP] Japan ..... 60-265297

[51] Int. Cl.[4] ..... B41J 25/28

[52] U.S. Cl. ..... 400/352; 400/139; 400/283

[58] Field of Search ..... 400/141, 141.1, 121, 400/161, 320, 354, 354.1, 352, 139, 283; 101/93.15, 93.37, 93.43, 382 MV; 384/8

[56] References Cited

U.S. PATENT DOCUMENTS

| | | | |
|---|---|---|---|
| 3,245,512 | 4/1966 | Heyer | 400/354 |
| 3,618,514 | 11/1971 | Nyman et al. | 101/93.16 |
| 4,012,676 | 3/1977 | Giebler | 400/126 |
| 4,349,284 | 9/1982 | Andersson | 400/328 |
| 4,381,896 | 5/1983 | Shiurila | 400/320 |
| 4,465,386 | 8/1984 | Shimalda et al. | 400/121 |

FOREIGN PATENT DOCUMENTS

| | | | |
|---|---|---|---|
| 0157624 | 10/1985 | European Pat. Off. | 400/121 |

*Primary Examiner*—Edgar S. Burr
*Assistant Examiner*—James A. Lisehora
*Attorney, Agent, or Firm*—Bruce L. Adams; Van C. Wilks

[57] ABSTRACT

Disclosed is a device for carrying a printing head which comprises, a first guide shaft disposed in parallel with a platen, a second guide shaft disposed in parallel with the first guide shaft, a carriage slidably supported by the first and second guide shafts, a printing head mounted on the carriage so as to be opposite to the platen, and a permanent magnet provided on the carriage so as to be opposite to an outer peripheral surface of the first guide shaft. The magnetic attraction force of the magnet with respect to the first guide shaft is set to be larger than gravity acting onto the printing head and the carriage when the magnet is arranged to be in opposition to a lower side portion of the outer peripheral surface of the first guide shaft, while set to be large enough to prevent the carriage from floating due to printing force of the printing head against the platen when the magnet is arranged to be in opposition to an upper side portion of the outer peripheral surface of the first guide shaft.

15 Claims, 3 Drawing Sheets

DEVICE FOR CARRYING PRINTING HEAD

BACKGROUND OF THE INVENTION

1. Field of the Invention

The present invention relates to a device for carrying a printing head used in a printer or the like.

2. Description of the prior Art

FIG. 5 shows an example of a conventional device for carrying a printing head in the prior art. Referring to FIG. 5, in the printing head carrying device, there are provided a first guide shaft 2 disposed in parallel with a platen 1, a second guide shaft 3 disposed in parallel with the guide shaft 2, and a carriage 5 mounting a printing head 4 thereon and being slidably supported by the first and second guide shafts 2 and 3 such that the printing head is opposed to the platen 1. The carriage 5 is provided with a through hole 6 through which the guide shaft 2 is passed, and a set of a projecting portion 5*a* and a pressing plate 7 which sandwiches the guide shaft 3 therebetween. The carriage 5 is further provided with a support groove 5*b* and a protrusion 5*c*, and the pressing plate 7 is provided with protrusions 7*a* and 7*b*. The support groove 5*b* and the protrusion 7*a* are engaged with each other and a spring 8 is hooked between the protrusions 5*c* and 7*b*, so that holding force is applied onto the projecting portion 5*a* and the pressing plate 7.

In the foregoing prior art structure, a dimensional error of the guide shafts and the carriage has produced a clearance between the first guide shaft and the through hole through which the first guide shaft is passed and which is formed in the carriage. Particularly, recently, because plastic or the like is used as a material for the carriage and injection molding or the like is employed as the method of forming the carriage, a dimensional error in forming the carriage is large and wear between the carriage and the guide shafts sliding movement becomes a serious factor for making the clearance large, resulting in a large obstacle to the improvement in printing quality.

Namely, in the state where printing is not performed, the printing head is normally lowered by a quantity of the clearance by the gravitational force acting onto the printing head and the carriage. If printing is started, however, the printing force of the printing head against the platen causes the carriage to float and hence the printing head is also caused to float as the carriage floats. The quantity of floating is not fixed but changed owing to various factors such as the number and the positions of dots to be formed, a carrying speed of the printing head, and so on. Further, if the carriage is caused to slide while changing the quantity of floating, the sliding resistance changes irregularly, so that the driving speed of the printing head at the different positions becomes fluctuated. Accordingly, in the characters or the like printed on a recording paper, a waving phenomena is caused to thereby lower the printing quality.

In order to solve such the problems, the clearance should be prevented from being produced. To this end, however, it is necessary to finish the carriage and the guide shafts extremely accurately, so that the carriage and the printing head have been limited in structure, and the material and the weight of them have been also limited because of countermeasure against wear. Accordingly, the cost has become extremely high and the design has been much limited.

SUMMARY OF THE INVENTION

An object of the present invention is to provide a device for carrying a printing head, which is not so expensive, which has a simple structure, and which solves the above-mentioned problems.

In order to attain the above-mentioned objects, the device for carrying a printing head, according to the present invention, comprises a first guide shaft made of a magnetic material and disposed adjacent to and in parallel with the platen, a second guide shaft disposed in parallel with the first guide shaft, a carriage slidably supported by the first and second guide shafts, a printing head mounted on the carriage so as to be opposed to the platen, and a permanent magnet provided on the carriage so as to be opposed to an outer peripheral surface of the first guide shaft.

Preferably, the permanent magnet is selected such that when the permanent magnet is disposed in opposed relation to a lower side portion of the outer peripheral surface of the first guide shaft, the magnetic attraction force with respect to the first guide shaft is larger than gravity acting onto the printing head and the carriage.

Further the permanent magnet is selected such that when the permanent magnet is disposed in opposed relation to an upper side portion of the outer peripheral surface of the first guide shaft, the magnetic attraction force with respect to the first guide shaft is large enough to prevent floating of the carriage due to printing force of the printing head against the platen from occurring.

Preferably, the carriage is provided with a through hole through which the first guide is passed, and another through hole through which the second guide shaft is passed or a mechanism for sandwiching the second guide shaft.

The permanent magnet provided on the carriage so as to be opposed to the outer peripheral surface of the first guide shaft is selected such that the magnetic attraction force with respect to the first guide shaft is larger than the gravity acting onto the printing head and the carriage when the permanent magnet is disposed in opposed relation to the lower side portion of the outer peripheral surface of the first guide shaft, so that the lower side portion of the outer peripheral surface of the first guide shaft and the lower side portion of the through hole through which the first guide shaft is passed are normally in contact with each other at a predetermined position, and the carriage is normally kept elevated by a quantity of a clearance. When the permanent magnet is arranged to be opposed to the upper side portion of the outer peripheral surface of the first guide shaft, on the other hand, the magnetic attraction force of the permanent magnet with respect to the first guide shaft is set to be large enough to prevent the carriage from floating due to the printing operation of the printing head, so that the upper side of the outer peripheral surface of the first guide shaft and the upper side of the inner peripheral surface of the through hole are normally in contact with each other at a predetermined position and the carriage is normally kept lowered by a quantity of a clearance.

Accordingly, while the printing head is performing printing, the locus of the sliding movement of the carriage draws a straight line parallel with the platen and there occurs no change in sliding resistance. Therefore, the printing head can be carried normally at a constant speed along a path on a straight line parallel with the transversal direction of the recording paper.

DETAILED DESCRIPTION OF PREFERRED EMBODIMENTS

Figure 1:
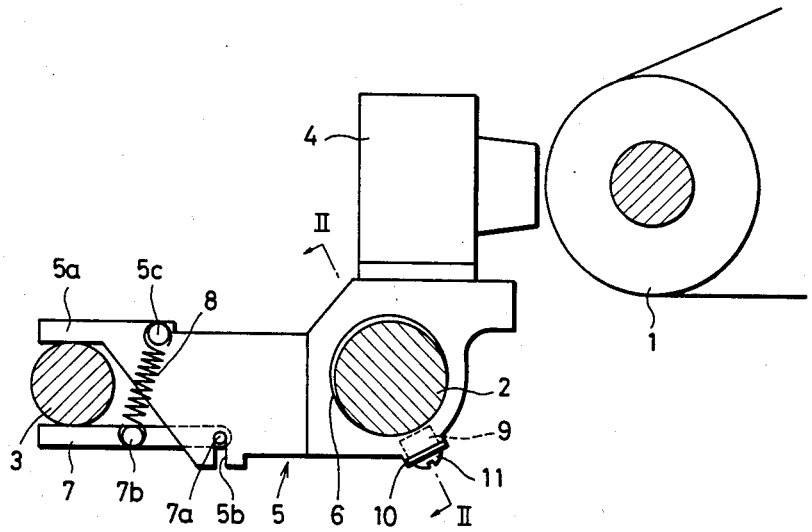
FIG. 1 is a side view of an embodiment of the device for carrying printing head according to the present invention.

Referring to the drawings, embodiments according to the present invention will be described.

Figure 2:
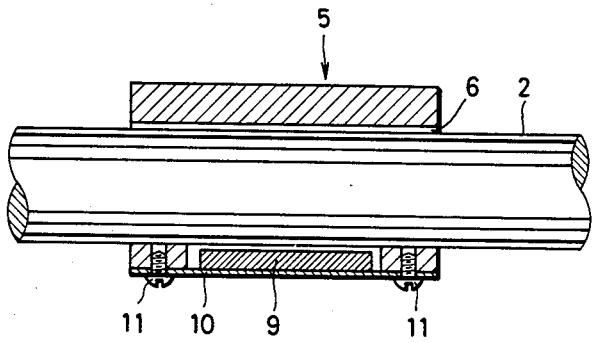
FIG. 2 is a cross-section taken along line II—II in FIG. 1.

FIG. 1 shows an embodiment according to the present invention. In FIG. 1, there are provided a first longitudinal guide shaft 2 disposed adjacent to and in parallel with a platen 1 and a second longitudinal guide shaft 3 disposed in parallel with the first guide shaft 2. A movable carriage 5 on which a printing head 4 is mounted so as to be opposed to the platen 1 is supported by the first and second guide shafts slidably in the longitudinal direction thereof. The carriage 5 is provided with a through hole 6 through which the first guide shaft 2 is slidably received with a clearance, and a set of a projecting portion 5*a* and a pressing plate 7 which constitutes means for sandwiching therebetween the second guide shaft 3. A support groove 5*b* and a protrusion 5*c* are provided in and on the carriage 5, respectively, and protrusions 7*a* and 7*b* are provided on the pressing plate 7. The support groove 5*b* is engaged with the protrusion 7*a* and a spring 8 is hooked between the protrusions 5*c* and 7*b*, so that holding force is applied inwardly onto the opposed projecting portion 5*a* and the pressing plate 7 so as to sandwich therebetween the second guide shaft 7. A permanent magnet 9 is fixed on the carriage 5 so as to be opposed to the outer peripheral surface of the first guide shaft 2 at its lower surface side. FIG. 2 is a cross-section of a fixing portion of the permanent magnet 9. As will be apparent from FIG. 2, a permanent magnet support plate 10 provided with the permanent magnet 9 fixed thereon with a bonding agent or the like is attached to the carriage 5 by screws 11, so that the permanent magnet 9 is disposed in parallel with the first guide shaft 2 with a predetermined gap therebetween.

In this case, the magnetic attraction force of the permanent magnet 9 with respect to the first guide shaft 2 is set to be larger than the gravitational force acting on the printing head and the carriage to prevent the carriage 5 from floating downwardly relative to the first guide shaft 2.

Figure 5:
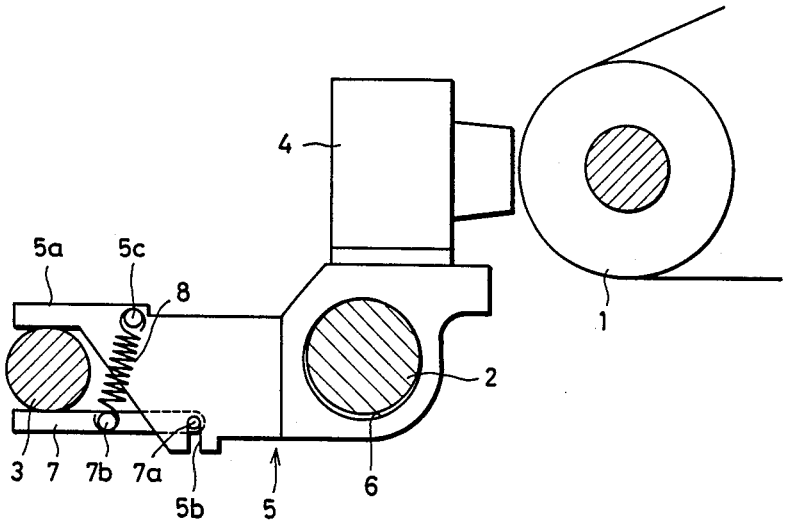
PRIOR ART FIG. 5
FIG. 5 is a side view of a conventional device for carrying a printing head.

In this embodiment, substantially the same parts as those of the prior art structure illustrated in FIG. 5 are correspondingly referenced to.

Figure 3:
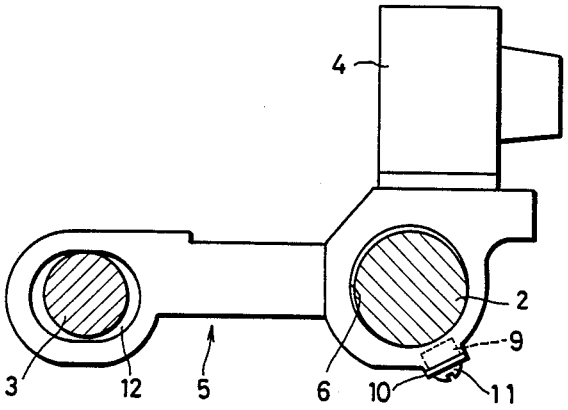
FIG. 3 is a side view of another embodiment of the device for carrying printing head according to the present invention.

FIG. 3 shows another embodiment of the present invention. In this embodiment which is a modification of the first embodiment of FIG. 1, a through hole 12 through which the second guide shaft 3 is received is formed in the carriage 5 at a portion where the second guide shaft 3 would contact with the carriage 5 as in the embodiment of FIG. 1. The remaining portions of the arrangement are quite the same as the embodiment of FIG. 1 and substantially the same parts are correspondingly referenced to. In the portion of the carriage at which the second guide shaft is in contact with the carriage, it is not always necessary to provide such a through hole as in this embodiment or such a sandwiching mechanism as shown in FIG. 1, but any means may be sufficient if the means has a structure in which the second guide shaft can stably slidably suppport the carriage in cooperation with the first guide shaft.

Figure 4:
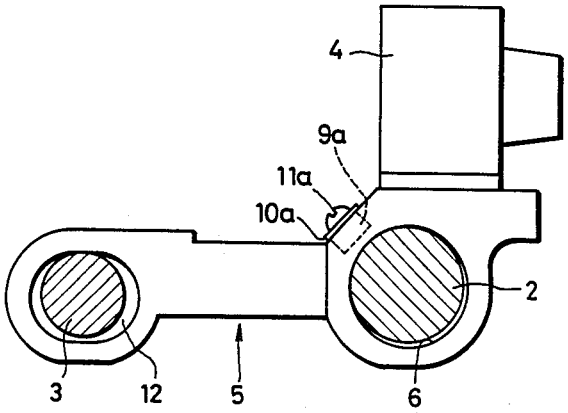
FIG. 4 is a side view of further embodiment of the device for carrying printing head according to the present invention.

FIG. 4 shows a further embodiment of the present invention. In this embodiment, a permanent magnet 9*a* is fixed on the carriage 5 in opposed relation to the outer peripheral surface of the first guide shaft 2 at its upper surface side. The permanent magnet 9*a* is fixed in the same manner as in the two foregoing embodiments. Namely, a permanent magnet support plate 10*a* provided with the permanent magnet 9*a* fixed thereon with a bonding agent or the like is attached to the carriage 5 by screws 11*a*, so that the permanent magnet 9*a* is disposed in parallel with the first guide shaft 2 with a predetermined gap therebetween. In this case, the magnetic attraction force of the permanent magnet 9*a* with respect to the first guide shaft 2 is set to be large enough to prevent the carriage 5 from floating upwardly relative to the first guide shaft 2 due to the printing operation of the printing head during the sliding movement. The other portions of the structure are quite the same as those in the embodiment of FIG. 3, and substantially the same parts are correspondingly referenced to. Also in the embodiment, in the portion of the carriage at which the second guide shaft is in contact with the carriage, it is not always necessary to provide such a through hole as in this embodiment, but such a sandwiching mechanism of FIG. 1 or any other means may be sufficient if the means has a structure in which the second guide shaft can stably slidably support the carriage in cooperation with the first guide shaft. Further, although the permanent magnet is fixed onto the carriage by using a permanent support plate and screws in the three foregoing embodiments, the permanent magnets may be integrally molded with the carriage at a desired position.

In the device for carrying a printing head according to the present invention, the printing head can be normally driven at a constant speed along a path on a straight line parallel with the transversal direction of a recording paper without being influenced by a clearance caused by dimensional errors of the guide shaft and carriage as well as a wear of carriage, so that characters or the like printed on a printing paper can be remarkably improved in their printing quality.

What is claimed is:

1. A platen, and a device for carrying a printing head along said platen comprising:

a first guide shaft made of a magnetic material and disposed adjacent to and in parallel with said platen;

a second guide shaft disposed in parallel with said first guide shaft;

a carriage slidably supported by said first and second guide shafts;

a printing head mounted on said carriage so as to be opposed to said platen; and means to prevent said carriage from floating relative to said first guide shaft including a permanent magnet provided on said carriage opposed to the outer peripheral surface of said first guide shaft said permanent magnet being positioned so as to exert a magnetic force on said first shaft sufficient to prevent said carriage from floating relative to said first shaft.

2. A device for carrying a printing head according to claim 1; wherein said permanent magnet is disposed so as to be opposed to a lower side portion of the outer peripheral surface of said first guide shaft such that a magnetic attraction force of said permanent magnet with respect to said first guide shaft is set to be larger than the force of gravity acting on said printing head and said carriage.

3. A device for carrying a printing head according to claim 1; wherein said permanent magnet is disposed so as to be opposed to an upper side portion of the outer peripheral surface of said first guide shaft such that a magnetic attraction force of said permanent magnet with respect to said first guide shaft is set to be large enough to prevent said carriage from floating movement due to printing force of said printing head against said platen.

4. A device for carrying a printing head according to claim 1; wherein said carriage is provided with a first and a second through hole through which said first and second guide shafts are received, respectively.

5. A device for carrying a printing head according to claim 1; wherein said carriage is provided with a through hole through which said first guide shaft is received, and means for sandwiching said second guide shaft.

6. A device for carrying a printing head, comprising: a pair of longitudinal guide means disposed in parallel to each other, at least one of the longitudinal guide means being composed of magnetic materials and having a peripheral surface; carriage means mounted to undergo sliding movement along the pair of longitudinal guide means for carrying thereon a printing head to move the same in the longitudinal direction of the guide means; and means for preventing the carriage means from floating relative to said one of said longitudinal guide means composed of magnetic material including a permanent magnet member fixed to the carriage means in closely opposed relation to the peripheral surface of said one longitudinal guide means and positioned so as to be magnetically attracted to the peripheral surface with a force sufficient to prevent the carriage means from floating relative to said one longitudinal guide means during the sliding movement of the carriage means along the longitudinal guide means.

7. A device for carrying a printing head according to claim 6; wherein the pair of longitudinal guide means comprise a first guide shaft composed of magnetic material and a second guide shaft.

8. A device for carrying a printing head according to claim 7; wherein the carriage means has a through hole for slidably receiving therein the first guide shaft with a clearance therebetween.

9. A device for carrying a printing head according to claim 8; wherein the carriage means includes means for fixing the permanent magnet member inside the through hole in opposed relation to the upper peripheral surface of the first guide shaft to thereby prevent the carriage means from floating upwardly relative to the first guide shaft.

10. A device for carrying a printing head according to claim 9; wherein the permanent magnet member has a magnetic attraction force sufficient to prevent the carriage means from floating upwardly due to an external force applied to the printing head.

11. A device for carrying a printing head according to claim 8; wherein the carriage means includes means for fixing the permanent magnet member inside the through hole in opposed relation to the lower peripheral surface of the first guide shaft to thereby prevent the carriage means from floating downwardly relative to the first guide shaft.

12. A device for carrying a printing head according to claim 11; wherein the permanent magnet member has a magnetic attraction force larger than the gravitational force applied to the carriage means and printing head and effective to prevent the carriage means from floating downwardly.

13. A device for carrying a printing head according to claim 8; wherein the carriage means has another through hole for slidably receiving therein the second guide shaft.

14. A device for carrying a printing head according to claim 8; wherein the carriage means includes means for sandwiching the second guide shaft.

15. A device for carrying a printing head according to claim 6; wherein the carriage means includes means for carrying thereon a printing head in opposed relation to a platen which extends adjacent to and in parallel with said one longitudinal guide means.

* * * * *